United States Patent [19]

Russo

[11] 4,154,127

[45] May 15, 1979

[54] OPENER FOR SCREW TOP CONTAINERS

[76] Inventor: Anthony J. Russo, 23768 Wimbledon Rd., Shaker Heights, Ohio 44122

[21] Appl. No.: 855,407

[22] Filed: Nov. 28, 1977

[51] Int. Cl.[2] ..... B67B 7/36

[52] U.S. Cl. ..... 81/3.3 R

[58] Field of Search ..... 81/3.3 R, 3.3 A, 3.44, 81/90 B, 109, 110

[56] References Cited

U.S. PATENT DOCUMENTS

| | | | |
|---|---|---|---|
| 1,182,567 | 5/1916 | Ipsen | 81/110 X |
| 1,281,209 | 10/1918 | Richey | 81/110 |
| 2,373,210 | 4/1945 | Van Genderen | 81/90 B |
| 3,140,622 | 7/1964 | Russo | 81/3.3 R |
| 3,862,776 | 1/1975 | Sims et al. | 81/3.44 X |

*Primary Examiner*—James L. Jones, Jr.
*Assistant Examiner*—James G. Smith

[57] ABSTRACT

An opener for screw top containers having a base adapted to be secured to a wall, one or more notches in the front face of the base and an arm having at one end a jaw with a gripping surface, and at the other end a pivot, the arm being adjustable to one of a number of positions relative to the base to accommodate a variety of bottle cap sizes.

3 Claims, 9 Drawing Figures

OPENER FOR SCREW TOP CONTAINERS

BACKGROUND OF THE DISCLOSURE AND PRIOR ART

This invention relates to openers for screw top containers, and more particularly to an improved bottle cap remover.

In my prior U.S. Pat. No. 3,140,622 I have shown and described a form of opener for screw top containers characterized by a base which is adapted to be secured to a vertical wall surface. Pivotally attached to the base is an arm having at its free end a jaw including gripping means, such as a serrated edge for engaging a screw type bottle cap, and holding it against rotation while resting in a notch in the base while appropriate twisting force is applied to the container.

The present invention is an improvement on the prior structure. The prior structure was conveniently formed of a moldable plastic, and in order to accommodate a variety of sizes of bottle caps employed a jaw member having an integral curved and serrated inner face. The present structure enables the use of straight metallic serrated members thus improving the ease of construction and the durability of the jaw member. Also, the present device provides for concealment ofthe serrated jaw surface when the device is not in use, thus eliminating a possible source of injury.

To provide the advantages above described and others as will later appear, the structure has been modified to provide for a plurality of positions of the pivot point for the arm so that adjustment for a variety of sizes of bottle caps can be accommodated and a terminal or storage position with the serrated edge of the jaw concealed. Straight serrated jaw inserts may be provided instead of the more complicated contoured serrated surface. These devices are desirably formed from an injection moldable plastic material, and an inserted serrated blade or pair of blades of metal is clearly more durable than a molded serrated jaw surface integral with the jaw member.

BRIEF STATEMENT OF THE INVENTION

Briefly stated, the present invention is in a device for loosening a screw top on a container to facilitate removal thereof. The device is characterized by a base having a stationary jaw surface for engaging the screw top of a container, and a swingable arm pivotally mounted on the base and having a pivot pin at one end. A depending jaw member is provided at the other end of the arm for movement into confronting relation with the stationary jaw surface. Gripping means are provided for holding a screw top to resist rotation of the top with the container during loosening. The improvement of the present invention comprises a plurality of discrete pin seats in the base for the pivot pin whereby the distance between the depending jaw member and the stationary jaw may be selectively changed.

In more specific embodiments of the present invention, the discrete pivot pin seats each communicate with a common channel dimensioned for sliding movement of the pivot pin therealong during selection of a given pivot pin seat.

In a still more specific embodiment of the invention, the gripping means on the movable jaw is formed from a metallic insert which is straight rather than curved, and which in the storage condition is disposable between front and rear wall members.

BRIEF DESCRIPTION OF THE DRAWINGS

The present invention may be better understood by having reference to the annexed drawings showing a preferred embodiment of the invention, and wherein.

DETAILED DESCRIPTION OF THE DRAWINGS

As indicated, the present invention relates to a device for loosening a screw top on a container to facilitate removal thereof. Housewives frequently have considerable difficulty in removing screw tops from containers, particularly where the top is applied to a container in which the internal air pressure has been reduced.

Figure 2:
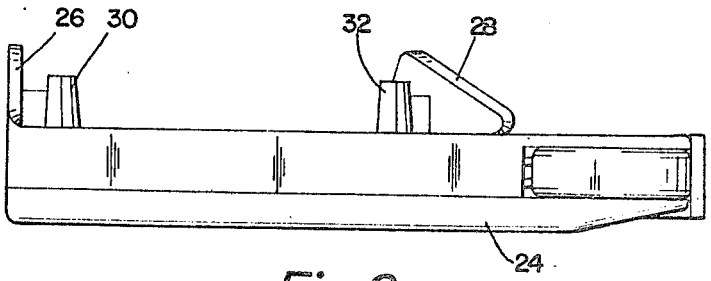
FIG. 2 is a top view of the device shown in FIG. 1 with the arm shown in the storage position.

Referring now more particularly to the annexed drawings, there is shown a device having a base generally indicated by the number 10 and having at one end a stationary jaw portion 12 composed of angularly related surfaces 14 and 16 forming a first notch. For smaller size containers, there may be provided a second notch formed by the angularly related surfaces 18 and 20. The base 10 is provided with a fear wall 22 and a front wall 24 (FIG. 2).

Figure 4:
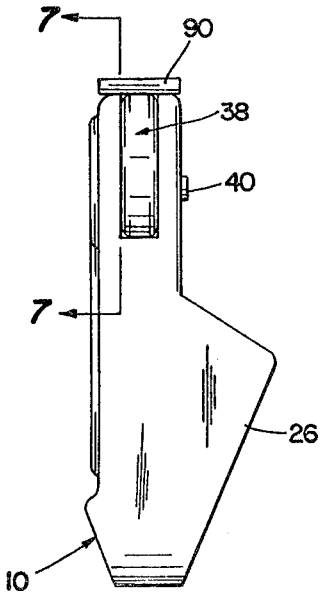
FIG. 4 is an end view showing the pivot end of the arm in the device of FIG. 1.
Figure 5:
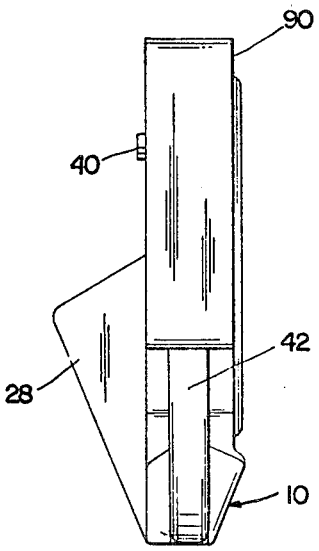
FIG. 5 is an end view from the jaw end of the arm.
Figure 6:
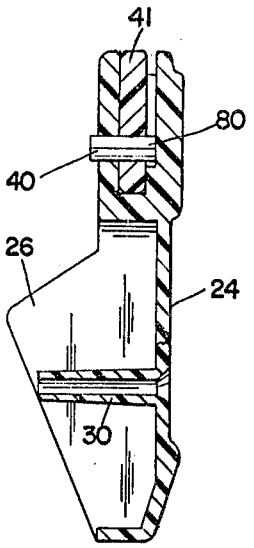
FIG. 6 is a cross-sectional view of the device as it appears in the broken plane indicated by the line 6—6 in FIG. 1.
Figure 9:
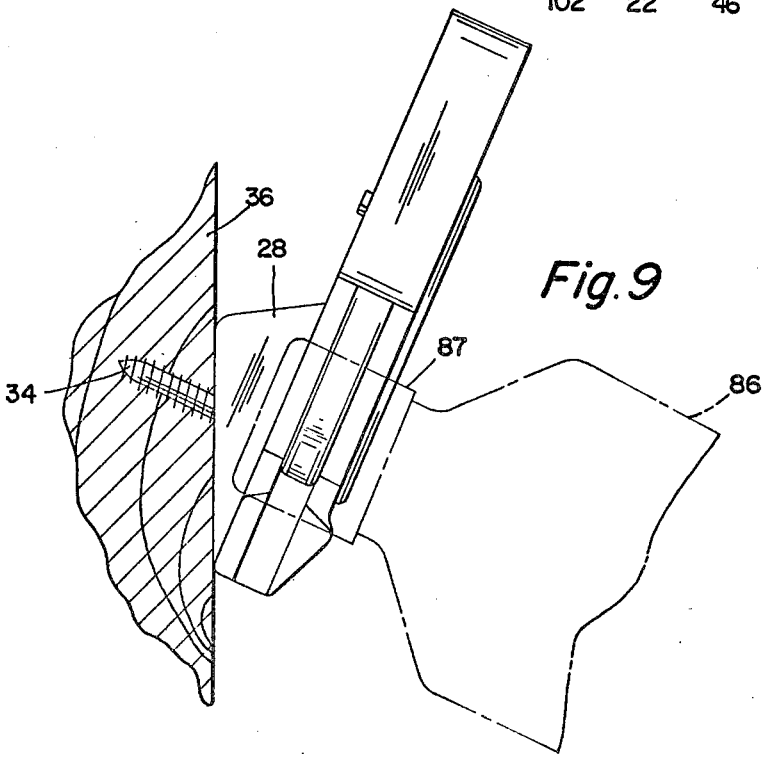
FIG. 9 is an illustration of the device from the jaw end thereof mounted on a vertical surface and showing the relative position of a container with a screw top in position for loosening of the top.

To facilitate mounting the device on a vertical surface such as shown in FIG. 9, the base is conveniently provided with outwardly projecting spacing ribs 26 and 28 which are sloped relative to the base 10 as best shown in FIGS. 4 and 5 to impart a convenient slope to the device relative to a vertical mounting surface. To aid in securing the base to a vertical surface as shown in FIG. 9, there are conveniently provided a pair of integral screw-receiving tubular members 30 and 32 through which a standard flat head wood screw, such as the screw 34 in FIG. 9, may extend into a vertically disposed wooden member, such as the member 36 shown in FIG. 9.

The device of the present invention is provided with a swingable arm 38 which is pivotally mounted on the base 10 and has a pivot pin 40 at one end of the arm, and a depending jaw member 42 at the other end. When the arm 38 with the integral jaw member 42 is rotated about the pivot pin 40, the depending jaw member is brought into confronting relation with the stationary jaw surface 12. The depending jaw member is conveniently provided with a metallic gripping member 44 having a saw tooth or serrated gripping edge 46. For convenience in assembly, the gripping member 44 is a straight member adapted for insertion and frictional retention in a suitable slot in the depending jaw member 42 as will be discussed below.

Figure 1:
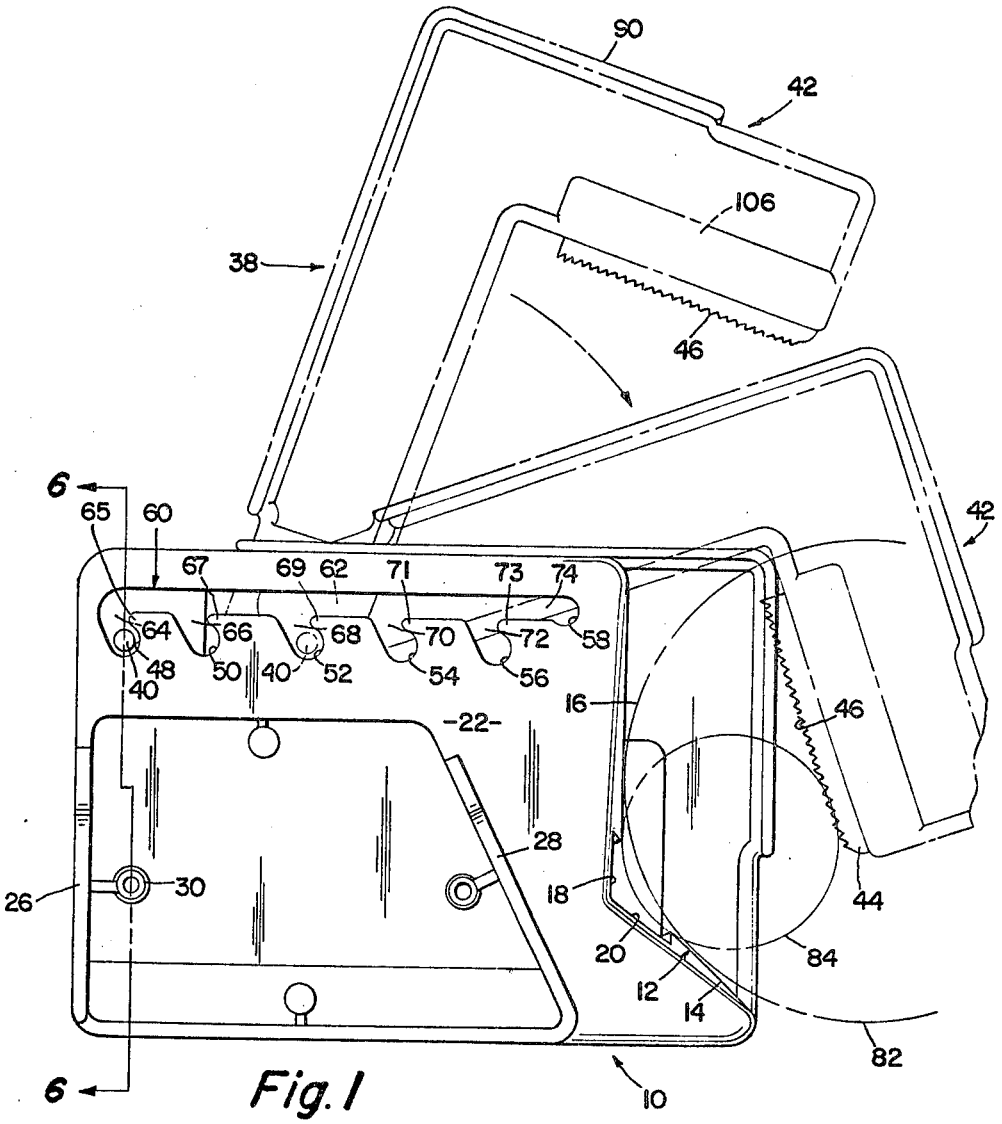
FIG. 1 is a plan view from the rear side of a device in accordance with the present invention, and illustrating the movement of the arm and movable jaw member.

The screw top loosening device of the present invention is characterized in that it is provided with a plurality of discrete pivot pin seats 48–58 as shown in FIG. 1. In the illustrated embodiment, the rear wall 22 is provided with a configured opening 60 having a common channel 62 communicating with each of a plurality of side channels 64–72 which are preferably angularly disposed at an acute angle with respect to the common channel 62 and which terminate in the discrete pivot pin seats 48–56, respectively. A terminal channel portion 74 is provided as an extension of the common channel 62 for entry of the pin 40 into the discrete pivot pin seat 58. With the exception of the terminal channel portion 74 side channels 64–72 are conveniently provided with a retention lip, such as the retention lips 65, 67, 69, 71, and 73 to restrain unintentional or inadvertent disengagement of the pivot pin 40 from its selected seat. It will be observed that the distance between the lips 65–73 and the opposite wall of the side channels 64–72 is less than the maximum width of the seats 48–58 at the distal ends thereof. Thus the lips 65–73 form a slight constriction at the entry into the side channels 48–56 tending to hold the pivot pin 40 in place when in one such seat during use.

Figure 7:
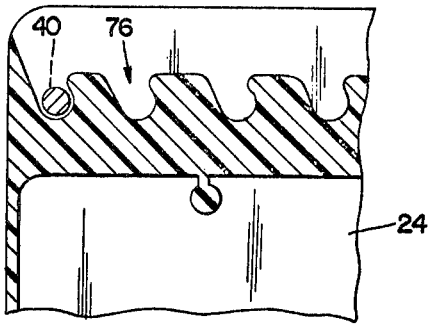
FIG. 7 is a fragmentary cross-sectional view of the device as it appears in the plane indicated by the line 7—7 in FIG. 4.

The pivot pin 40 is conveniently a steel pin which is frictionally retained in the end 41 of the pivot arm 38, and bilaterally extends therefrom for engagement with the cut out portion 60 in the rear wall 22, and for engaging with a similarly configured portion 76 which is integrally cast with the front wall 24 (FIG. 7) but does not extend through front wall 24 for reasons of appearance.

The cut out portion 60 in the rear wall 22, and the correspondingly configured portion 76 serving as a rest for the projecting portion 80 of the pin 40, are dimensioned so that the arm with the pin 40 may be elevated out of a given pivot seat, e.g., the pivot seat 48, and moved along the side channel 64, for example, into the common channel 60, and relocated into the discrete pivot pin seat 52 through the side channel 68. This type of movement into any of the selected channels enables the distance between the movable jaw member 44 and the stationary jaw surface 12 to be adjusted to accommodate different size containers as shown by the dotted lines 82 and 84 in FIG. 1.

In use, a given discrete pivot pin seat is selected depending upon the size of the screw top container to be opened, and the arm 38 pivoted about the pin 40 to bring the serrated edge 46 into gripping engagement with one side of the screw cap, for example, the screw cap 84 which is rested against the surfaces 14 and 16. Twisting of the container 86 (FIG. 9) in a counterclockwise direction with the screw cap 87 gripped between the stationary jaw surface 12 and the movable jaw surface 44 facilitates loosening of the screw cap 87 for easy removal thereof.

The arm 38 is conveniently provided with a bilaterally extending flange 90 to enable the arm to be gripped by the operator and moved to the desired position and brought into gripping relation with the screw top to be loosened. The direction of rotation for loosening the cap, such as the cap 87 is such as to tend to tighten the grip of the movable jaw member on the cap.

Figure 3:
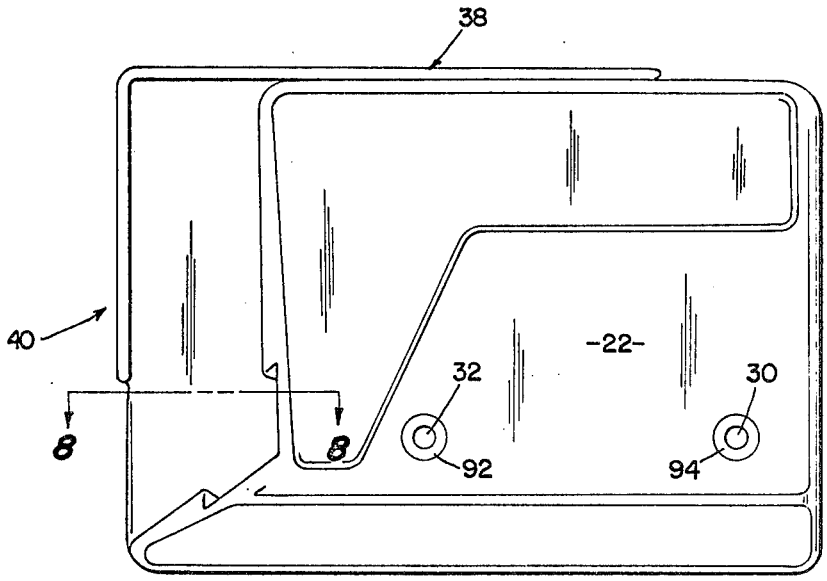
FIG. 3 is a plan view of the device shown in FIG. 1 from the front side.
Figure 8:
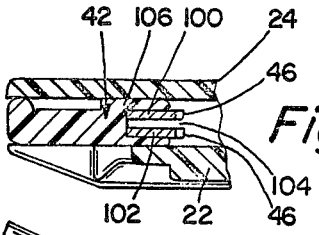
FIG. 8 is a fragmentary cross-sectional view of the device as it appears in the plane indicated by the line 8—8 in FIG. 3.

Referring to FIG. 3, the device of FIG. 1 is shown from the opposite side with the screw receiving tubes 32 and 30 opening into the front surface of the front wall 22, and suitably countersunk as at 92 and 94 for the receipt of flat head wood screws as indicated above. As shown in FIG. 3, the serrated edge 46 of the gripping element 44 is obscured in this storage position. As best shown in FIG. 8, the gripping means is composed of a pair of parallel steel members 100 and 102 frictionally retained in a slot 104 in the depending jaw portion 42. In this portion, the straight blades with the serrated edge 46 are stored between the front wall 22 and the rear wall 24 so that the sharp saw teeth of the gripping edge 46 are protectively covered. For strengthening the jaw 42 in the region of the gripping edge 44, there is conveniently provided a raised portion 106. The raised portion 106 also serves to fill out the thickness of the depending jaw portion 42 for frictional engagement between the confronting surfaces of the front wall 22 and the rear wall 24 so that some slight amount of pressure is required to open the arm 38 in readiness for use.

As indicated above, the devices of the present invention are conveniently formed from a thermosetting injecting molding plastic composition any of a number of which may be used as a material of construction. Suitable pigmentary materials may be included with the resin for decorative purposes.

Accordingly, there has been provided an improved device for loosening screw tops on containers to facilitate removal thereof. These devices are characterized in that they provide a plurality of discrete positions about which a movable jaw member may be pivoted whereby the distance between the depending jaw member and the stationary jaw may be selectively changed. The devices are conveniently formed by injection molding, and usually no more than two cavities are required to produce first the base member, and second the pivotable arm and depending jaw member. The gripping edge is separately placed in a suitable slot for frictional retention therein, and a separate steel pin provided in the opposite end of the arm for enabling pivotal movement thereof with respect to the base.

What is claimed is:

1. A device for loosening a screw top on a container to facilitate removal thereof, said device including a base having a front and a rear wall member in spaced relation to define a first slot extending across the top of said device and a second slot extending along at least one side, said at least one side including a stationary jaw surface having a toothed edge for gripping engagement with a screw top, an arm pivotally mounted in and slidable along said first slot, said arm having a pivot pin at one end thereof perpendicularly projecting therefrom and a depending jaw at the other end thereof, said depending jaw including a second toothed edge for gripping engagement with a screw top, said second toothed edge being selectively retractable into said second slot defined by said front and rear wall members and protectively covered thereby, a closed common channel having a plurality of discrete depending pivot pin seats communicating therewith, said common channel being disposed inwardly of and along the top marginal edge of at least one of said front and rear wall members for receiving said pivot pin, said common channel and depending pivot pin seats defining a closed pathway which coacts with said pivot pin to provide selectable pivot points and to enable selective adjustment of the distance between the depending jaw member and the said stationary jaw surface, and to enable retracting of said jaw member into said second slot.

2. A device in accordance with claim 1 wherein said pivot pin seats include means to restrain unintentional removal of the pivot pin therefrom.

3. A device in accordance with claim 2 wherein said means includes a constriction in the width of the pathway at the entry of the depending channel into the common channel.

* * * * *